US005377478A

United States Patent [19]

Kovacs et al.

[11] Patent Number: 5,377,478

[45] Date of Patent: Jan. 3, 1995

[54] PACKAGE FORMING APPARATUS FOR PACKAGING MACHINE

[75] Inventors: Lloyd Kovacs, Sheboygan, Wis.; Mario Tosetti, Bergamo, Italy

[73] Assignee: Hayssen Manufacturing Company, Sheboygan, Wis.

[21] Appl. No.: 68,212

[22] Filed: May 27, 1993

[51] Int. Cl.[6] ..... B65B 9/06; B65B 41/12

[52] U.S. Cl. ..... 53/550; 53/389.5

[58] Field of Search ..... 53/550, 551, 552, 389.5, 53/450, 451

[56] References Cited

U.S. PATENT DOCUMENTS

| | | | |
|---|---|---|---|
| 2,636,654 | 4/1953 | Sykes | 53/389.5 X |
| 3,099,118 | 7/1963 | Stelling, Jr. | 53/389.5 X |
| 4,035,983 | 7/1977 | Shanklin et al. | 53/450 |
| 4,288,965 | 9/1981 | James | 53/551 X |
| 4,430,844 | 2/1984 | James | 53/550 X |
| 4,537,016 | 8/1985 | Shanklin et al. | 53/550 X |
| 4,620,409 | 11/1986 | McElvy | 53/389.5 X |
| 4,642,969 | 2/1987 | Johnson | 53/550 X |
| 4,858,416 | 8/1989 | Monaghan | 53/389.5 X |
| 5,177,935 | 1/1993 | Jones et al. | 53/550 X |
| 5,285,621 | 2/1994 | Ballestrazzi et al. | 53/389.5 X |

*Primary Examiner*—Horace M. Culver
*Attorney, Agent, or Firm*—Lee, Mann, Smith, McWilliams Sweeney & Ohlson

[57] ABSTRACT

A system for enveloping items, such as collections of rolls, in plastic film for later downstream package completion. The film, which is in the form of an elongated sheet, is continuously shaped into a tube about a forming apparatus having an orifice extending across the path of travel of the items being packaged. A pair of segmented conveyors located on opposite sides of the path of travel of the items convey the items into the tube. The conveyors conform to the shape of the orifice of the forming apparatus. Another downstream pair of conveyors conveys the tube and items to downstream sealing apparatus. The second pair of conveyors each have segments which can be retracted so that forming apparatus of different sizes can be employed to form packages of different dimensions.

23 Claims, 5 Drawing Sheets

PACKAGE FORMING APPARATUS FOR PACKAGING MACHINE

BACKGROUND OF THE INVENTION

This invention relates to packaging machinery, and in particular to a system for enveloping a group of items in plastic film as the items follow a path of travel.

The invention is directed to horizontal form, fill and seal machinery, and particularly to that type of machinery in which items to be packaged are collected in groups, conveyed into a plastic film which has been formed into a tube surrounding the items, and then conveyed with the tube for downstream sealing into discrete packages or bundles. Other applications of the invention are possible, however.

In a form, fill and seal machine, it is important that items be conveyed quickly and accurately in groups for enveloping in the plastic film so that the packages can be regularly and fully sealed in a continuous process. It is imperative that the groups be properly spaced as they enter the tube of plastic film, and if the film has graphics, it is also important that the groups be inserted in the film in registration with the graphics so that after the packages are completed, the graphics are in proper alignment in relation to their contents.

Various types of forming boxes or apparatus have been used in the past to form plastic film into a tube enveloping the items to be packaged. Since the film totally surrounds the items in a continuous tube, compensation must be made to permit the plastic to be formed to surround the path of travel and form about the items to be packaged. To this end, inlet conveyors have been utilized, terminating where the plastic film enters the path of travel (from a side) and envelopes the items. In a typical apparatus, the film and items are then engaged by side pull belts which convey the tube and enveloped items downstream for later sealing. Anytime that different types of belts are employed, synchronization of the belts becomes important to assure proper conveyance of the packaged items. The more different types of belts are used, the more difficult the synchronization becomes.

If a forming box is used to shape the plastic film into the tube, due to the necessary geometry of the forming box, the box must extend at an oblique angle across the path of travel of the items as they enter the film tube. If the items are being conveyed on a flat conveyor, that conveyor must terminate where it first meets the forming box. A downstream conveyor for conveying the tube and the items must also terminate where it meets the forming box. Due to the oblique angle of the forming box, a substantial gap will exist between the conveyors where there is no positive conveyance of the travelling items. While the gap may be acceptable for items which are quite wide and which therefore may bridge the forming box from the upstream conveyor to the downstream conveyor, it is disadvantageous to have such a gap when items smaller than the gap are being packaged.

SUMMARY OF THE INVENTION

The invention pertains to a system for enveloping items in a plastic film as the items are being continuously conveyed along a path of travel. The system includes a source of film in an elongated sheet, a forming apparatus for continuously shaping the film into a tube about the items, and means for inserting the items into the tube. The forming apparatus has an orifice which includes a portion extending across the path of travel at other than a right angle. The means for inserting items into the tube comprises at least one segmented conveyor comprising a plurality of parallel conveyor segments which are all driven at an equal surface velocity. The conveyor segments are formed to conform to the shape of the orifice portion of the forming apparatus.

In accordance with the preferred form of the invention, the means for inserting comprises a pair of the segmented conveyors, the conveyors being located on opposite sides of the path of travel of the items. Preferably, the conveyor segments comprise a series of separate, drivingly interconnected endless parallel belts.

The forming apparatus comprises a forming box, and the orifice of the forming box is formed to have a contour corresponding to the cross section of the items to be packaged. The orifice extends across the path of travel of the items at an oblique angle. The belts of the conveyor segments all have differing lengths conforming to the contour of the forming box. In the preferred form, the invention also includes means for conveying the formed tube with items therein. The conveying means comprises at least one further segmented conveyor which also comprises a plurality of parallel conveyor segments all driven at the same surface velocity as the upstream conveyor segments. Preferably, a pair of the further segmented conveyors is employed on opposite sides of the formed tube.

For accommodating different sizes of forming boxes, at least a portion of the conveyor segments of the further, downstream conveyor are retractable. Like the conveyor segments of the upstream conveyor, the conveyor segments of the downstream conveyor comprise endless belts. In the downstream conveyor, each belt is carried in a frame, at least a portion of the frames comprising a pair of frame parts, with the frame parts being pivotally united such that one frame part is pivotal with its belt relative to the frame part to which it is joined.

The tension of the film is regulated between the source of the film and the forming apparatus. In accordance with the preferred form of the invention, tensioning comprises a pair of spaced, parallel tension rolls. The rolls are mounted for rotation in opposite end brackets, each of the brackets having a pivotal axle located between the rolls for pivoting of the rolls and the brackets as a unit. Means is provided for pivoting the unit about the axles to maintain constant, desired tension in the film at all times.

BRIEF DESCRIPTION OF THE DRAWINGS

The invention is described in greater detail in the following description of an example embodying the best mode of the invention, taken in conjunction with the drawing figures in which.

DESCRIPTION OF AN EXAMPLE EMBODYING THE BEST MODE OF THE INVENTION

Figure 1:
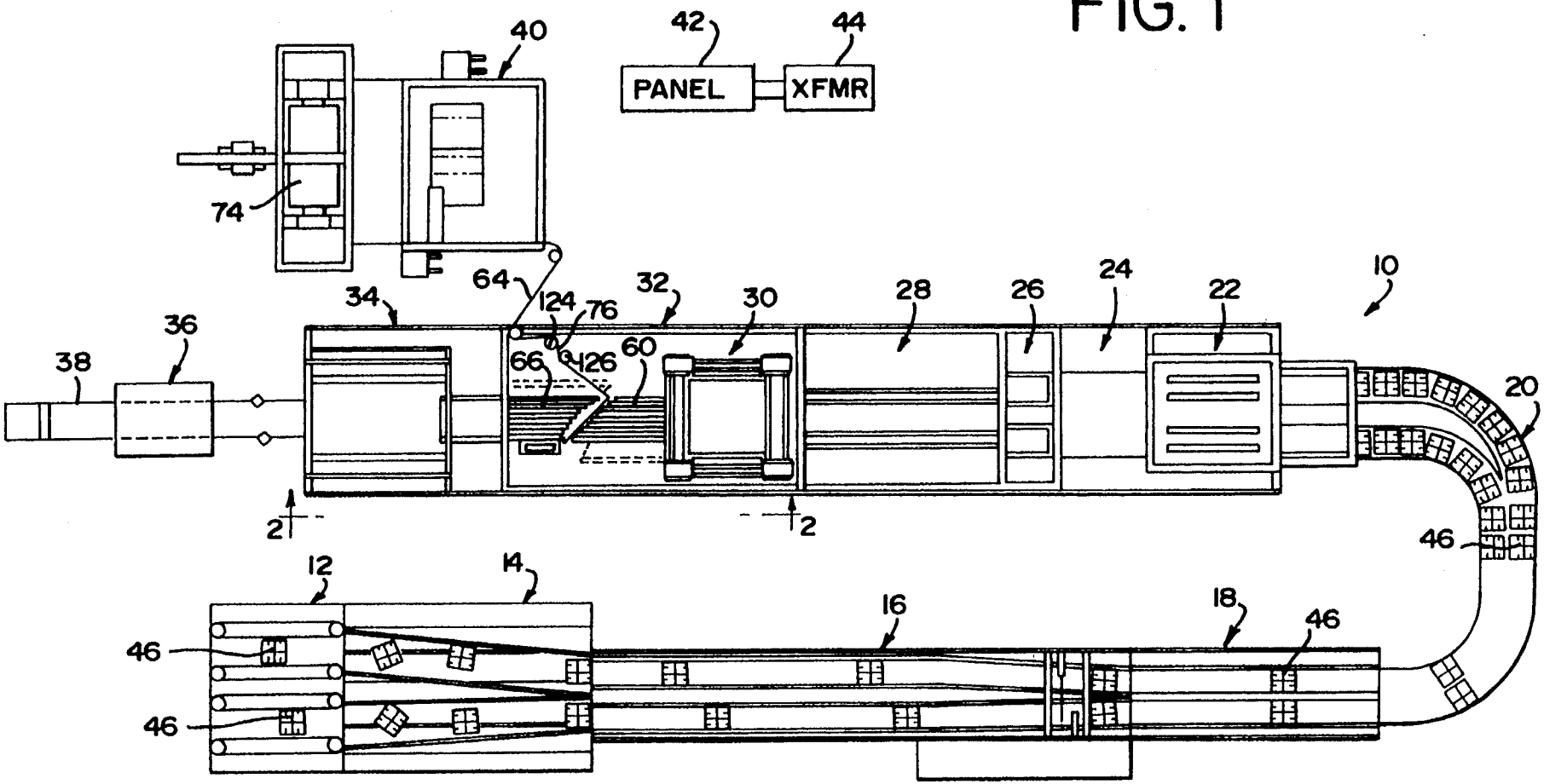
FIG. 1 is an overall schematic view of one form of a complete packaging and sealing apparatus, including the film enveloping system according to the invention.

A machine employing the film enveloping apparatus according to the invention is shown generally at 10 in FIG. 1. The machine 10 consists of many sections or portions which may be included in a packaging apparatus, and which may be conventional and which are therefore not described in greater detail with the exception of those portions in proximity to the enveloping apparatus. The machine 10 in turn is supplied at its inlet end with the products or items to be sealed from what may be a conventional source of such products (not illustrated). From its inlet end, the machine 10 consists of an initial belt arrangement 12 for gathering the products, followed by a roll core turning and roll-up section 14 for changing product orientation. Next is a diverter conveyor 16 which diverts product into desired lanes, followed by a short conveyor 18, which is followed by a further elongated conveyor 20 which shifts the flow direction of the product from left to right in the lower portion of FIG. 1 to right to left in the upper portion of FIG. 1. The conveyor 20 is followed by a top belt arrangement 22 for accumulating product and which leads to a transfer chute 24. Next in line are synchronization flights 26, followed by an upender section 28. Next is the accumulation section 30, followed by a forming box section 32 according to the invention leading to a sealing section 34. Finally, fully wrapped and accumulated product exits the apparatus 10 to a product doubler 36 and then to an outlet conveyor 38. Plastic film is fed to the forming box section 32 from a film handling apparatus 40, and general control of the machine 10 is via a control panel 42 which may include a computer or other process control. Power to the machine 10 is transformed through a voltage transformer 44 in a conventional fashion.

An item 46 to be packaged enters the machine 10 at the belt arrangement 12, from whence it is turned, diverted, conveyed, synchronized, upended and accumulated before being packaged in the sealing section 34. In the particular illustration of the drawing figures, the item 46 comprises four rolls of paper, such as toilet tissue. A multiplicity of the items 46 are ultimately packaged in a single package in the sealing section 34. Just as easily, single rolls of toilet tissue, or larger rolls, such as paper towels, can be handled and packaged by the apparatus of the invention.

Figure 3:
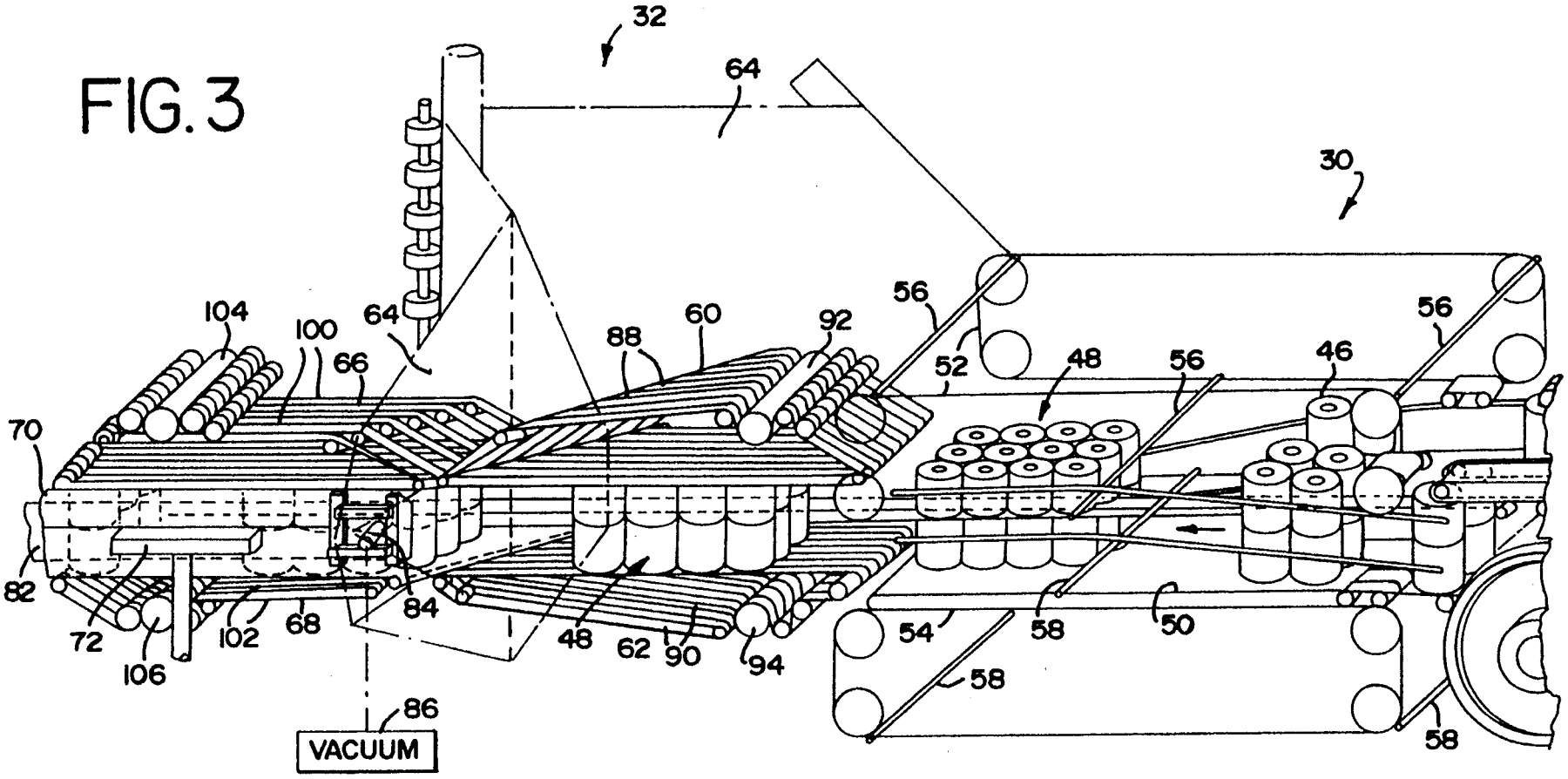
FIG. 3 is a perspective view of a portion of the invention from an accumulating flight through a lap sealer, where the tube is longitudinally sealed.

The items 46, after travelling through the machine 10, reach the accumulation section 30 shown partially in detail in FIG. 3. There, a predetermined number of the items 46 is accumulated as a group 48 on a dead plate 50 (FIG. 3). Synchronized top and bottom accumulation conveyors 52 and 54, having respective accumulation flights 56 and 58, convey the groups 48 across the dead plate 50 to the forming box section 32. The flights 56 and 58 are appropriately spaced, and the conveyors 52 and 54 are driven at an appropriate speed, in order to accumulate a desired quantity of the items 46 into a group 48. While groups of items four deep and three wide are shown accumulated in the accumulation section 30, it will be evident that adding or subtracting the number of the flights 56 and 58 attached to the conveyors 52 and 54 can change the number of items conveyed as a group 48 to the forming box section 32.

A group 48 enters the forming box section 32 between an upper segmented conveyor 60 and a lower segmented conveyor 62. The conveyors 60 and 62, and all segments thereof, are driven in unison so that the groups 48 remain as such. The conveyors 60 and 62 are segmented as a series of parallel belts so that unused portions of the conveyors 60 and 62 can be removed from service if desired. In addition, the belts of the conveyors 60 and 62 are of different lengths to accommodate the angular disposition of the form of the forming box (described below), as best shown in the top view of FIG. 1.

Figure 2:
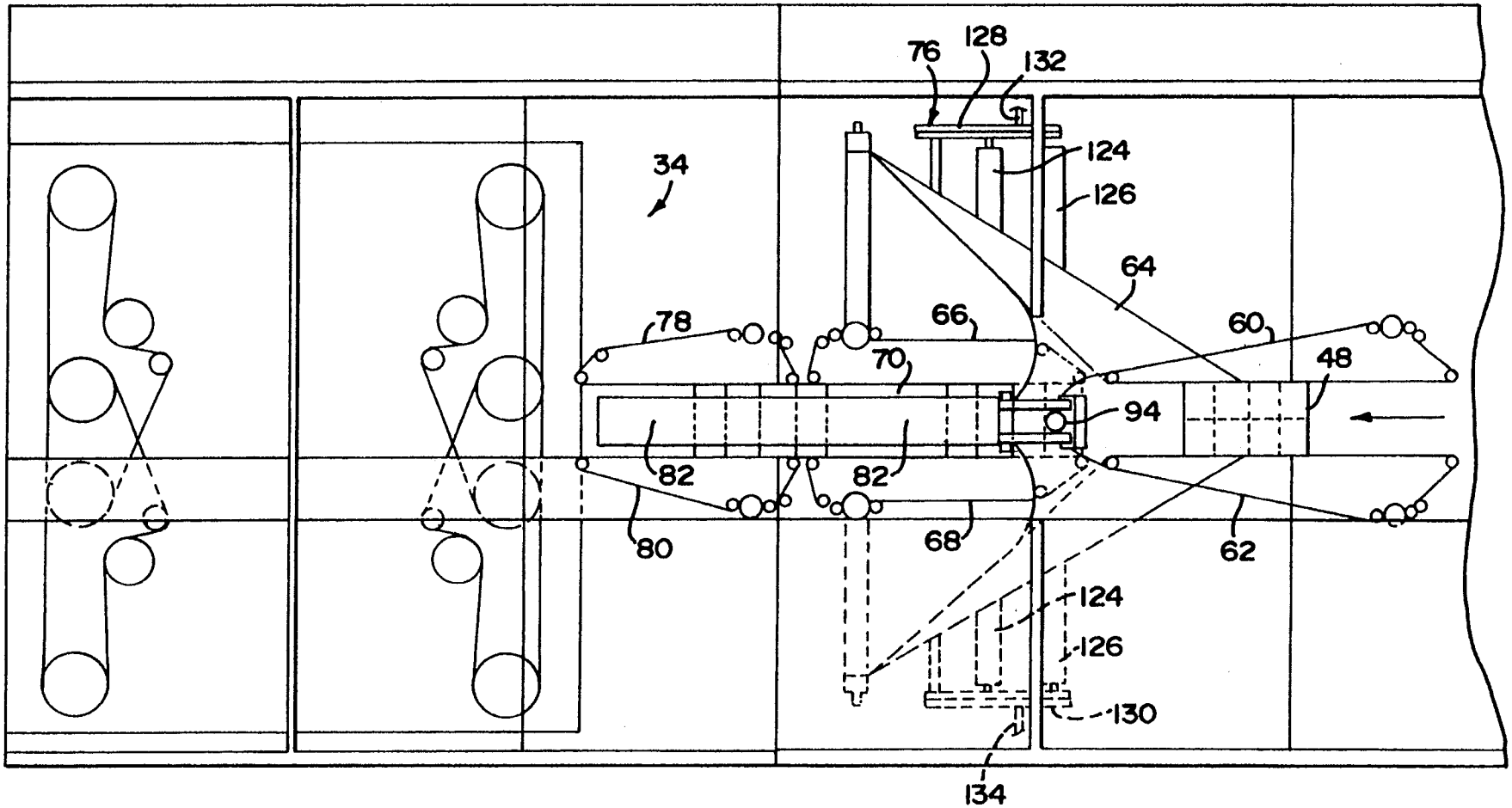
FIG. 2 is an enlarged side elevational illustration taken along lines 2—2 of FIG. 1, with portions omitted for clarity of description.

Plastic film 64 from the film handling apparatus 40 enters the forming box section 32, best illustrated in FIG. 3, passing over a curved forming box (described below) which forms the film 64 into an enveloping tube 70 extending between further upper and lower segmented conveyors 66 and 68. Groups 48 are transferred from the segmented conveyors 60 and 62 into the enveloping tube 70 of the film 64 between the conveyors 66 and 68, as best shown in FIGS. 2 and 3. Opposite edges of the film 64 overlap in the enveloping tube 70, and are sealed by a lap sealer 72 which preferably uses hot air to seal the overlapping portions of the film. The conveyors 60, 62, 66 and 68 are driven at the same, constant velocity, and the film enters between the conveyors 66 and 68 at the same surface velocity so that the groups 48 enter the enveloping tube 70 between the conveyors 66 and 68 at the exact surface speed of the film in order not to damage or stretch the film as the now-entubed group 48 is conveyed downstream within the enveloping tube 70.

The film handling apparatus 40 may be conventional. Film 64 is withdrawn from a roll 74, perforated or otherwise handled as needed, and then transmitted over a series of rollers to the forming box section 32. A film tension adjustment 76 shown in FIG. 2 and described in greater detail below is employed to accommodate slack in the film during start-up or shutdown of the machine 10, and in order to assure proper tension within the forming box section 32 during operation.

The groups 48, now entubed in a sealed enveloping tube 70 of the plastic film 64, exit the forming box section 32 into the sealing section 34 between a further pair of upper and lower conveyors 78 and 80. The conveyors 78 and 80 are driven at the same velocity as the conveyors 66 and 68, and may be segmented conveyors, or can be full width conveyors, as required.

As explained above, excess air must be withdrawn from the enveloping tube 70 before it is sealed in the sealing section 34. To this end, a conduit 82 extends longitudinally within the enveloping tube 70, terminating within the sealing section 34. The conduit preferably is flat, forming a backing for the lap sealer 72, and extending along one side of the groups 48 as they are conveyed from the forming box section 32 into the sealing section 34. The conduit 82 includes a nozzle 84 in the forming box section 32 located just upstream of where the film 64 overlaps to form the tube 70. The nozzle 84 is appropriately connected to a source of vacuum 86 illustrated in FIG. 3. The conduit 82 preferably has holes at its far left end (FIG. 2) through which air is withdrawn from the tube 70 into the conduit 82.

The sealing section 34 is described in greater detail in copending U.S. patent application Ser. No. 08/054,619, filed Apr. 29, 1993, the disclosure of which is incorporated herein by reference. The sealing section 34 includes three concatenated axes, each axis including two pairs of half dies driven in unison. Each axis comprises an upper pair of belts and a lower pair of belts driven by a common drive (not illustrated) to maintain the unison of the half dies.

Figure 4:
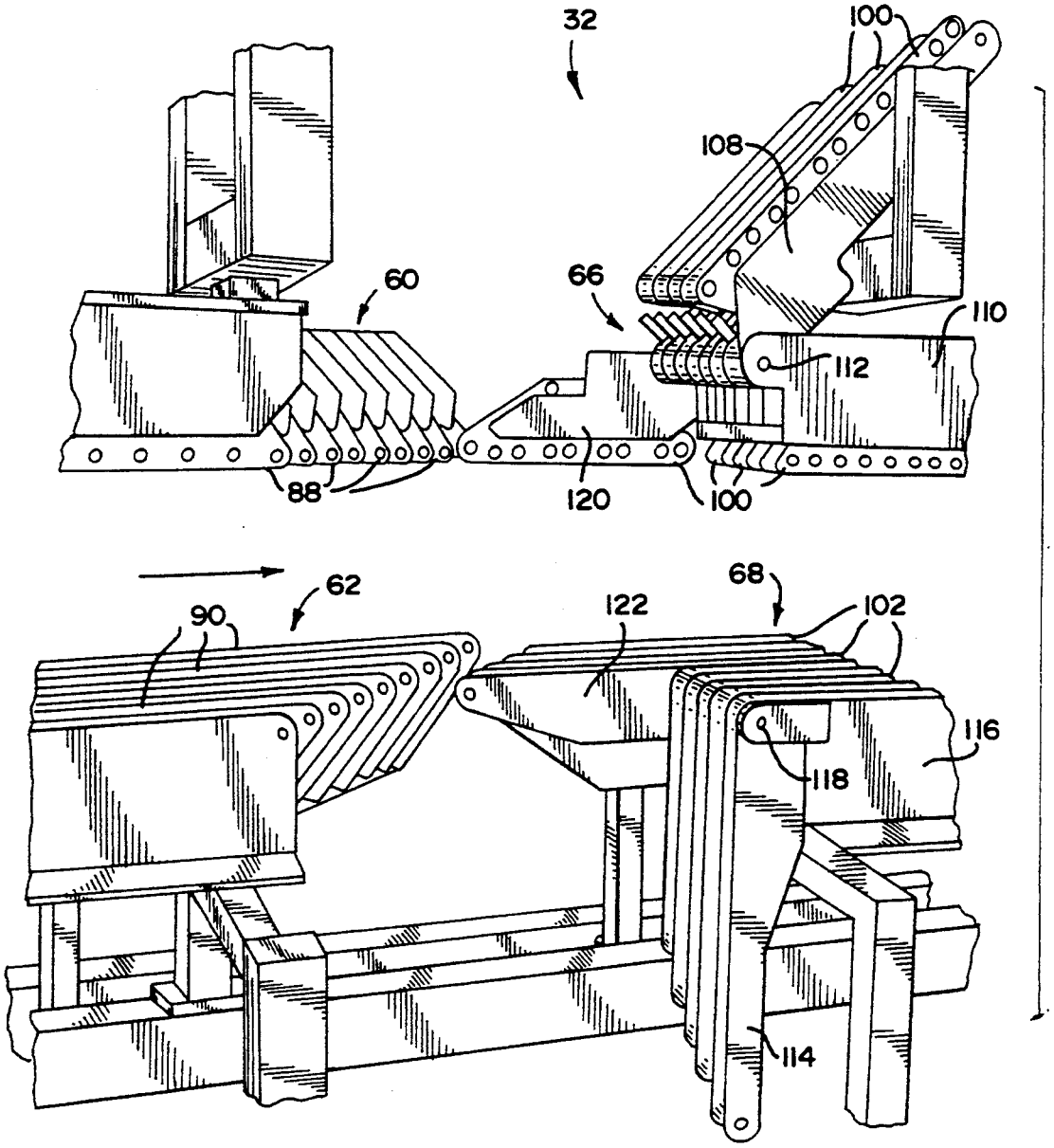
FIG. 4 is a perspective view of a portion of the film enveloping apparatus but with the forming box and plastic film removed for clarity, and showing some of the downstream conveyor segments being pivoted out of operative orientation.
Figure 5:
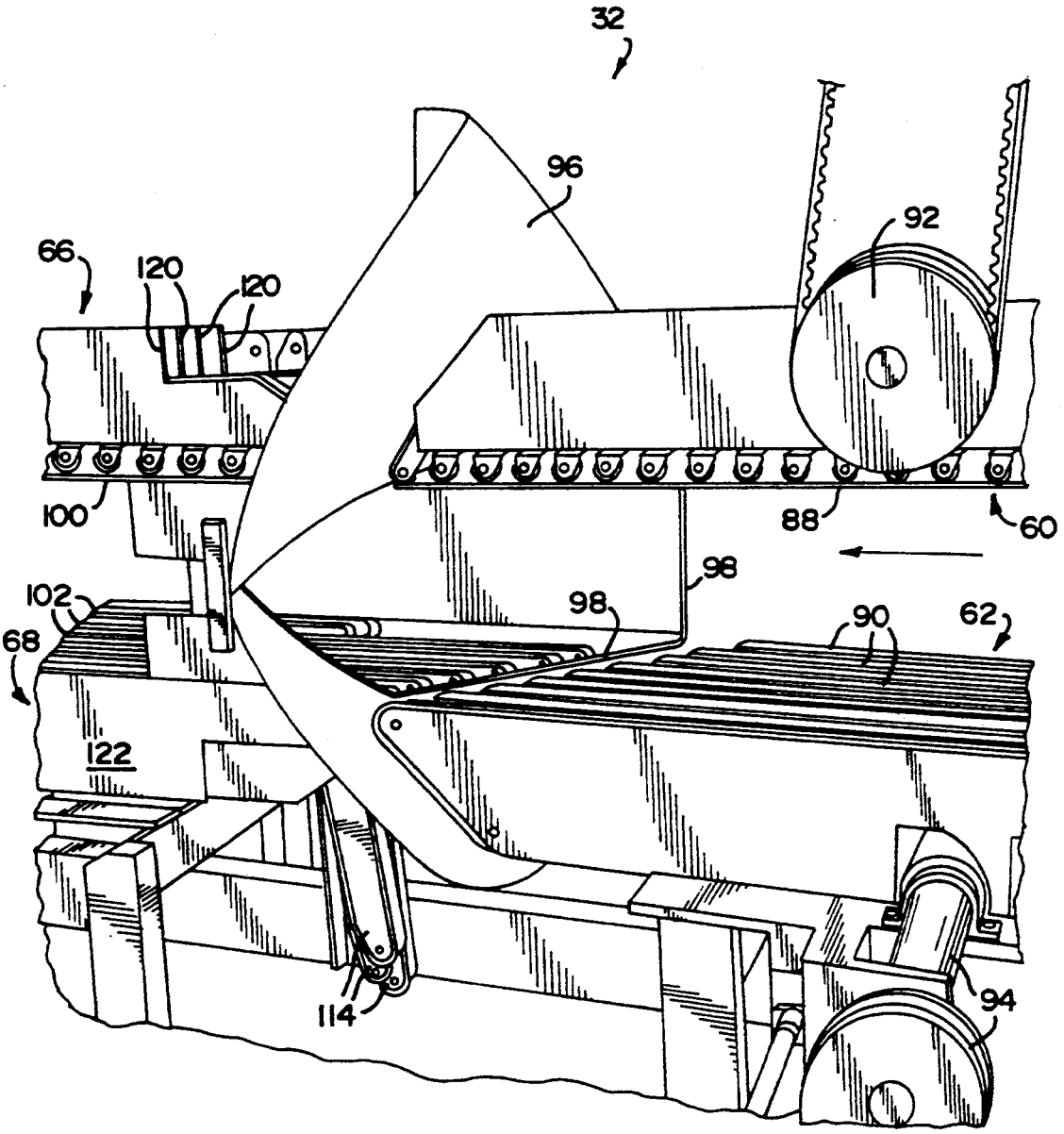
FIG. 5 is a perspective view of the film enveloping apparatus from the opposite side shown in FIG. 4, and also having the forming box in place for forming the plastic film into a tube, but omitting the plastic film for clarity of description.

Returning to the forming box section 32, as best illustrated in FIGS. 3–5, the upper and lower conveyors 60 and 62 each is composed of a series of separate, drivingly interconnected endless parallel belts. The conveyor 60 is composed of a series of belts 88, while the conveyor 62 is composed of a series of belts 90. Respective drives 92 and 94 drive all of the belts of the two conveyors 60 and 64 in unison, the drives 92 and 94 being driven by an appropriate motor (not illustrated).

The forming box section 32 includes a forming box 96 which, as illustrated in FIG. 5, is a curved structure having an orifice 98 through which the groups 48 (FIGS. 2 and 3) pass. The orifice extends across the path of travel of the groups 48 at an oblique angle, as shown in FIG. 5, with the angle being best shown in the top view illustrated in FIG. 1, that angle being between the succeeding conveyors 60 and 66. If the forming box is viewed from the upstream direction toward the orifice 98, the orifice 98 is shaped to conform to the contour of the cross section of a group 48 of items being packaged. Thus, although the orifice 98 extends at an oblique angle across the path of travel, when viewed from the upstream direction, the orifice 98 is shaped to approximate the generally rectangular cross section of a group 48, if rectangular.

Because the orifice 98 extends at an oblique angle across the path of travel, each of the belts 88 and 90 has a different length so that the respective belts extend as closely as possible to the orifice 98. Thus, in FIG. 5, the outboard belts 88 and 90 closest to the viewer would be the longest belts, while the inboard belts on the opposite side of the apparatus would be the shortest, with the belts inbetween the inboard and outboard belts decreasing in length commensurately to accommodate the angular disposition of the orifice 98 across the path of travel. Since the belts 88 and 90 are driven by the respective drives 92 and 94, the individual belts all travel at the same surface speed, thus conveying a group 48 into the forming box 96 without separating the individual items 46 forming the group 48.

Similar to the upstream conveyors 60 and 62, the downstream conveyors 66 and 68 are composed of parallel conveyor segments. The upper conveyor 68 is formed of a series of separate, drivingly interconnected endless parallel belts 100, while the lower conveyor 68 is formed of a like series of separate, drivingly interconnected endless parallel belts 102. The belts 100 and 102 are driven by respective drives 104 and 106 (FIG. 3) so that the belts 100 and 102 are driven at the same surface speed. Of course, as explained above, since it is required that the belts 60, 62, 66 and 68 be driven at the same surface velocity, preferably the drives 92, 94, 104 and 106 are driven in unison to accomplish that result.

The forming box 96 is located so that the film 64 laps on one side of a group 48. It will be evident that, if desired, the forming box 96 and the film handling apparatus 40 could be relocated and reconfigured so that the lap seam is on the top (or bottom). The configuration shown is preferred, but not mandatory.

The machine 10 is devised to form packages of differing sizes depending on the size and number of the items 46 incorporated into each package. When the cross-sectional dimension of the ultimately-formed package varies, the forming box 96 must be changed since the orifice 98 is formed to fairly closely approximate the cross-sectional dimension of the package being formed. When smaller packages are formed, a smaller orifice 98 is required in the forming box 96. In that instance, the full widths of the conveyors 60, 62, 66 and 68 are not employed, and in order to accommodate a forming box 96 for smaller packages, at least some of the segments of the conveyors 66 and 68 are formed to be retracted. As shown in FIGS. 4 and 5, each of the belts 100 of the upper conveyor 66 is carried in a frame comprising frame parts 108 and 110. The frame parts 108 and 110 of each of the conveyor segments include a pivotal joint 112 uniting the frame parts 108 and 110 so that the frame part 108 is pivotal (with its belt 100) relative to the frame part 110, which is fixed in place. Thus, as shown in FIG. 4, desired ones of the frame parts 108 can be pivoted upwardly as illustrated.

Similarly, at least some of the belts 102 of the lower conveyor 68 are carried in frames comprising frame parts 114 and 116 united by a pivotal joint 118. The frame part 114 is pivotal relative to the frame part 116, which is fixed in place. Thus, certain ones of the conveyor segments of the lower conveyor 16 can be pivoted downwardly as illustrated in FIGS. 4 and 5.

With certain of the frame parts 108 and 114 pivoted as illustrated in FIGS. 4 and 5, varying size forming boxes 96 can be fitted in place between the upstream conveyors 60 and 62 and the downstream conveyors 66 and 68. One size forming box 96 is shown in FIG. 5, with the necessary frame parts 108 and 114 (and their respective conveyor belts) being pivoted in order accommodate the forming box 96.

Normally, not all of the conveyor segments of the conveyors 66 and 68 need be mounted in frames having a pivotal frame part 108 and 114. Thus, as illustrated in FIG. 4, certain of the belts 100 of the upper conveyor 66 are mounted in fixed frames 120, and corresponding belts 102 of the lower conveyor 68 are mounted in fixed frames 122.

In a fashion similar to the individual belts 88 and 90 of the upstream conveyors 60 and 62, the individual belts 100 and 102 of the downstream conveyors 66 and 68 are sized so that the belt lengths conform to the configuration of the orifice of the forming box 96. Thus, only a very small gap occurs between each upstream belt 88 and 90 and its correspondingly paired downstream belt 100 and 102, that gap being sufficient to accommodate the size of the forming box 96 and the plastic film 64 passing thereover. In addition, because the orifice 98 is formed at an oblique angle across the path of travel of the groups 48, the gaps between the belts are staggered across the widths of the conveyors 60, 62, 66 and 68. As illustrated, very small gaps are necessary, permitting very small items to be conveyed through the apparatus 10 and still bridge the gaps between the upstream conveyors 60 and 62 and the downstream conveyors 66 and 68.

The tension adjustment 76 is used to regulate the tension of the film 64 to assure that the tension is relatively constant during operation of the machine 10. As shown schematically in FIG. 1 and as better shown in the elevational view of FIG. 2, the tension adjustment 76 comprises a pair of spaced, parallel tension rolls 124 and 126. The rolls 124 and 126 are mounted for rotation in opposite end brackets 128 and 130. A pivot axle 132 extends from the bracket 128, and a similar pivot axle 134 extends from the bracket 132. As illustrated, the axles 132 and 134 are located midway between the rolls 124 and 126 to allow pivoting of the tension adjustment 76 as a unit. The axles 132 and 134 are appropriately pivotally mounted in the frame of the machine 10 (not shown in detail).

The means of pivoting the tension adjustment 76 to regulate tension of the film 64 may be conventional, and preferably is controlled by the controller for the machine 10 located within the computer in the power control 42. The brackets 128 and 130 may be extended (to the left in FIG. 2), being joined by a fixed bar 136. The bar may be engaged by a pneumatic ram (not illustrated) or other means to pivot the tension adjustment 76 about the axles 132 and 134.

Achievements

Several advantages are enjoyed by the unique arrangement of the forming box section 32. Due to the use of individual belts forming each of the conveyors 60, 62, 66 and 68, gaps between the upstream and downstream conveyors are kept to an absolute minimum. Also, because the forming box 96 extends at an oblique angle across the path of travel of items passing through the forming box section 32, the individual belts of the conveyors 60, 62, 66 and 68 are staggered, further lessening the significance of any gap between the upstream and downstream conveyors.

Because certain portions of the downstream conveyors 66 and 68 are pivotal, they can be retracted out of the way, permitting varying sizes of forming boxes 96 to be employed in the forming box section 32 without completely changing the conveyors 66 and 68. This promotes an efficient, rapid changeover of the machine 10 from one size of package to another.

Other advantageous of the apparatus will be apparent from review of the description above and drawing figures. Various changes can be made to the invention without departing from the spirit thereof or scope of the following claims.

What is claimed is:

1. In an apparatus for packaging items in plastic film, a system for enveloping the items in the film comprising a. a source of film in an elongated sheet, b. forming apparatus for continuously shaping said film into a tube about said items in a path of travel of said items, said forming apparatus having an orifice including a portion extending across said path at an oblique angle, c. means for inserting said items into said tube, and d. means for conveying said tube with items therein, said conveying means comprising at least one segmented conveyor comprising a plurality of parallel conveyor segments all driven at an equal surface velocity, said conveyor segments conforming to said orifice portion.

2. A system according to claim 1 in which said inserting means comprises a pair of said segmented conveyors, said conveyors being located on opposite sides of said path of travel.

3. A system according to claim 2 in which said segments comprise a series of separate, drivingly interconnected endless parallel belts.

4. A system according to claim 3 in which said forming apparatus comprises a forming shoulder and said orifice has a contour corresponding to the cross section of the items to be packaged and extends about said path of travel at said oblique angle.

5. A system according to claim 4 in which said belts have differing lengths conforming to the contour of said forming box.

6. A system according to claim 1 in which said segments comprise a series of separate, drivingly interconnected endless parallel belts.

7. A system according to claim 6 in which said forming apparatus comprises a forming shoulder and said orifice has a contour corresponding to the cross section of the items to be packaged and extends about said path of travel at said oblique angle.

8. A system according to claim 7 in which said belts have differing lengths conforming to the contour of said forming shoulder.

9. A system according to claim 1 in which said conveying means comprises a pair of said segmented conveyors, said segmented conveyors being located on opposite sides of said tube.

10. A system according to claim 9 in which said forming apparatus comprises a forming shoulder and said orifice has a contour corresponding to the cross section of the items to be packaged and extends about said path of travel at said oblique angle.

11. A system according to claim 10 in which said segmented conveyors have differing lengths conforming to the contour of said forming shoulder.

12. A system according to claim 9 including means for retracting at least a portion of said conveyor segments of said segmented conveyor.

13. A system according to claim 12 in which each conveyor segment comprises an endless belt, each belt being carried in a frame, at least a portion of said frames comprising a pair of frame parts, and in which said retracting means comprises a pivotal joint uniting each of said frame parts such that one frame part is pivotal with said belt relative to the frame part joined to said one part.

14. A system according to claim 1 including means located between said source of film and said forming apparatus for regulating tension of said film.

15. A system according to claim 14 in which said means for regulating tension comprises a pair of spaced, parallel tension rolls, said rolls being mounted for rotation in opposite end brackets, each said bracket having a pivot axle located between said rolls for pivoting of said rolls and brackets as a unit, and including means for pivoting said unit about said axles.

16. In an apparatus for packaging items in plastic film, a system for enveloping the items in the film comprising a. a source of film in an elongated sheet, b. forming apparatus for continuously shaping said film into a tube about said items in a path of travel of said items, said forming apparatus having an orifice including a portion extending across said path at an oblique angle, c. means for conveying said tube with items therein, said conveying means comprising a first segmented conveyor comprising a plurality of parallel first conveyor segments all driven at an equal surface velocity, said first conveyor segments conforming to said orifice portion, and d. means for inserting said items into said tube, said inserting means comprising a second segmented conveyor comprising a plurality of parallel second conveyor segments all driven at said equal surface velocity, said second conveyor segments also conforming to said orifice portion.

17. A system according to claim 16 in which said forming means comprises a forming shoulder having a contour corresponding to the cross section of the items to be packaged and located between said first and second segmented conveyors at said oblique angle to said path of travel.

18. A system according to claim 17 in which said segments comprise a series of separate, drivingly interconnected endless parallel belts.

19. A system according to claim 18 in which said belts have differing lengths conforming to the contour of said forming shoulder.

20. A system according to claim 17 including means for retracting at least a portion of said first conveyor segments of said first segmented conveyor.

21. A system according to claim 20 in which each first conveyor segment comprises an endless belt, each belt being carried in a frame, at least a portion of said frames comprising a pair of frame parts, and in which said retracting means comprises a pivotal joint uniting each of said frame parts such that one frame part is pivotal with said belt relative to the frame part joined to said one part.

22. A system according to claim 16 including means located between said source of film and said forming apparatus for regulating tension of said film.

23. A system according to claim 22 in which said means for regulating tension comprises a pair of spaced, parallel tension rolls, said rolls being mounted for rotation in opposite end brackets, each said bracket having a pivot axle located between said rolls for pivoting of said rolls and brackets as a unit, and including means for pivoting said unit about said axles.

* * * * *